US007534162B2

(12) United States Patent
Bottema et al.

(10) Patent No.: US 7,534,162 B2
(45) Date of Patent: May 19, 2009

(54) GROOVED PLATEN WITH CHANNELS OR PATHWAY TO AMBIENT AIR

(75) Inventors: Brian E. Bottema, Austin, TX (US); Stephen F. Abraham, Austin, TX (US); Alex P. Pamatat, Austin, TX (US)

(73) Assignee: Freescale Semiconductor, Inc., Austin, TX (US)

( * ) Notice: Subject to any disclaimer, the term of this patent is extended or adjusted under 35 U.S.C. 154(b) by 352 days.

(21) Appl. No.: 11/221,375

(22) Filed: Sep. 6, 2005

(65) Prior Publication Data

US 2007/0054601 A1 Mar. 8, 2007

(51) Int. Cl.
*B24B 1/00* (2006.01)
*B24B 49/00* (2006.01)
*B24B 51/00* (2006.01)

(52) U.S. Cl. ..... 451/41; 451/8; 451/36; 451/59; 451/288

(58) Field of Classification Search ..... 451/5, 451/8, 36, 41, 59, 285–290
See application file for complete search history.

(56) References Cited

U.S. PATENT DOCUMENTS

| | | | | |
|---|---|---|---|---|
| 2,819,568 | A | 1/1958 | Kasick | |
| 6,086,464 | A | 7/2000 | Ulfig et al. | |
| 6,561,891 | B2 | 5/2003 | Eppert, Jr. et al. | 451/530 |
| 6,568,891 | B2 | 5/2003 | Eppert, Jr. et al. | |
| 6,599,765 | B1 * | 7/2003 | Boyd et al. | 438/16 |
| 6,699,104 | B1 | 3/2004 | Baker, III et al. | |
| 6,722,949 | B2 | 4/2004 | Hu et al. | |
| 6,887,138 | B2 | 5/2005 | Bottema et al. | 451/72 |
| 6,905,392 | B2 | 6/2005 | Bottema et al. | 451/5 |
| 7,179,151 | B1 * | 2/2007 | Bottema et al. | 451/6 |
| 7,210,980 | B2 * | 5/2007 | Swedek et al. | 451/6 |
| 7,226,339 | B2 * | 6/2007 | Benvegnu et al. | 451/6 |
| 7,354,334 | B1 * | 4/2008 | Birang et al. | 451/6 |
| 2001/0005667 | A1 | 6/2001 | Tolles et al. | |
| 2003/0181135 | A1 * | 9/2003 | Liu | 451/6 |
| 2004/0053566 | A1 * | 3/2004 | Tolles et al. | 451/285 |
| 2004/0209551 | A1 * | 10/2004 | Suzuki | 451/5 |
| 2005/0095963 | A1 | 5/2005 | Stark et al. | |

OTHER PUBLICATIONS

PCT International Search Report for PCT/US06/33473 mailed Sep. 26, 2007.

* cited by examiner

*Primary Examiner*—Timothy V Eley
(74) *Attorney, Agent, or Firm*—Hamilton & Terrile, LLP; Michael Rocco Cannatti

(57) ABSTRACT

A polish pad (120) and platen (130) assembly for use in chemical mechanical polishing of semiconductor devices includes a platen (130) having a grooved or channeled surface (136) which is sealed from the processing environment by an ungrooved portion (131) at the periphery of the platen (130). In addition, the platen (130) includes one or more passageways (132) that provide a pathway to ambient or sub-ambient environment. The combination of the sealing region (131) and the passageway(s) (132) prevent liquids, vapors or other undesirable contaminants from infiltrating between the pad and platen, and also vent trapped air pockets between the pad and platen.

13 Claims, 3 Drawing Sheets

GROOVED PLATEN WITH CHANNELS OR PATHWAY TO AMBIENT AIR

BACKGROUND OF THE INVENTION

1. Field of the Invention

The present invention is directed in general to the field of semiconductor manufacturing. In one aspect, the present invention relates to the equipment for use in chemical mechanical polishing (CMP) in the manufacture of integrated circuits. Additional applications include, but are not limited to, substrate polishing, MR head polishing, or hard disk polishing.

2. Description of the Related Art

In the manufacture of integrated circuits on semiconductor wafers, various layers are formed over one another. Each functional layer is formed by additive and subtractive processes in which various materials are added (deposited) to the wafer surface and removed (etched or polished) from the wafer surface. Each layer can have material selectively removed (through the combination of photolithography and etch processes) to produce a desired pattern on a wafer resulting in a non-planar surface topography. Additional materials may be deposited on top of the non-planar surface that maintains a similar topography. At any given stage in the fabrication of an integrated circuit, the non-planar surfaces can adversely affect subsequent processing steps, can lead to device failure and can reduce yield rates. For example, when metal lines are formed over a semiconductor structure, any non-planar surfaces can impede the ability to remove metal from the structure where it does not belong.

A common process for smoothing surface irregularities and removing overburden material is through chemical mechanical planarization or chemical mechanical polishing (CMP). Overburden material refers to the excess deposited material on the high surface of a wafer that is necessary to completely fill the low or recessed surface regions on the wafer. The CMP process typically involves pressing a semiconductor wafer against a polishing pad at a controlled pressure, where either or both of the wafer and pad are rotating with respect to one another. By spinning the polishing pad while the semiconductor wafer is pressed against the polishing pad in the presence of a chemically active or abrasive material or liquid media (slurry), the upper surface of the semiconductor wafer is planarized and overburden removed to a desired target. With CMP equipment, the polishing pad typically includes a pressure sensitive adhesive layer which is used to affix the pad to a supporting platen structure. However, during the application of a polish pad on the platen, air pockets or bubbles can form between the adhesive and the platen, thereby causing raised areas or bulges in the polishing surface of the polishing pad. Such bulges in the pad create non-uniformities on the polished surface, and can cause the pad to breakthrough or slip/break wafers during the polishing process. In addition, the bulges cause uneven wear of the pad, which can decrease the run time for a pad, increase costs, increase tool downtime and increase manufacturing cycle time. Prior attempts to remove trapped air—such as by forcing the air bubbles out from under the pad with a roller or manually puncturing the bulges—have not been effective. Other solutions for eliminating air pockets under a polished pad have used grooves between the pad and platen to prevent air pockets from forming, but such solutions failed to prevent the intrusion of processing environment fluids between the platen and pad, which can adversely affect adhesion between the pad and platen, and can impair endpoint signal detection.

Accordingly, a need exists for an improved CMP equipment assembly that eliminates the entrapment of air between the platen and the polishing pad. In addition, there is a need to prevent infiltration of processing environment fluids from entering between the polishing pad and platen. There is also a need for an improved apparatus and device to overcome the problems in the art, such as outlined above. Further limitations and disadvantages of conventional processes and technologies will become apparent to one of skill in the art after reviewing the remainder of the present application with reference to the drawings and detailed description which follow.

BRIEF DESCRIPTION OF THE DRAWINGS

The present invention may be understood, and its numerous objects, features and advantages obtained, when the following detailed description is considered in conjunction with the following drawings, in which.

Figure 1:
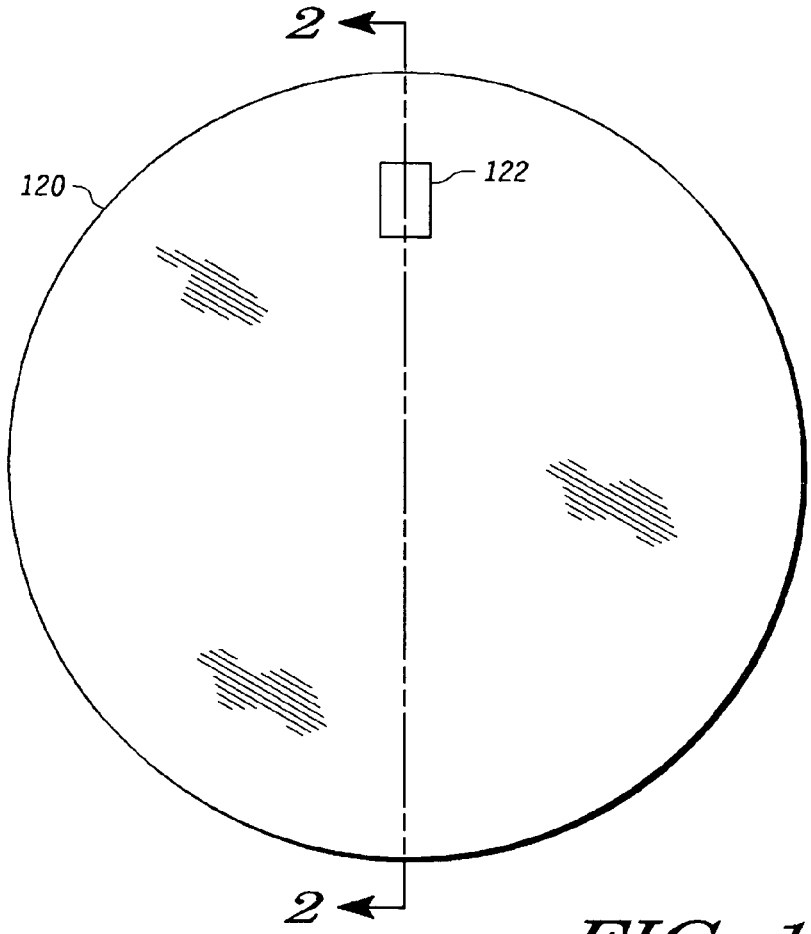
FIG. 1 illustrates a top view of a polishing pad.

It will be appreciated that for simplicity and clarity of illustration, elements illustrated in the drawings have not necessarily been drawn to scale. For example, the dimensions of some of the elements are exaggerated relative to other elements for purposes of promoting and improving clarity and understanding. Further, where considered appropriate, reference numerals have been repeated among the drawings to represent corresponding or analogous elements.

DETAILED DESCRIPTION

A polish pad and platen assembly having a grooved or channeled surface is described for preventing or reducing the formation of bubbles between the polishing pad and platen surfaces by venting trapped air pockets through one or more passageways that provide a pathway to ambient or sub-ambient environment and that do not allow intrusion of liquid vapor or other undesirable contaminants from the polishing process. The disclosed polish pad and platen assembly may be used to increase the lifetime of polish pads used in manufacturing a semiconductor wafer at any stage of manufacture, including but not limited to inter-layer dielectric (ILD), shallow trench isolation (STI), tungsten and copper layer polish processes. The disclosed polish pad and platen assembly also prevents infiltration of polishing by-products between the pad and platen, thereby maintaining the pad/platen adhesion and protecting the integrity of the endpoint signal detection system from contamination. Various illustrative embodiments of the present invention will now be described in detail with reference to the accompanying figures. While various details are set forth in the following description, it will be appreciated that the present invention may be practiced without these specific details, and that numerous implementation-specific decisions may be made to the invention described herein to achieve the device designer's specific goals, such as compliance with process technology or design-related constraints, which will vary from one implementation to another. While such a development effort might be complex and time-consuming, it would nevertheless be a routine undertaking for those of ordinary skill in the art having the benefit of this disclosure. For example, selected aspects are depicted with reference to simplified drawings in order to avoid limiting or obscuring the present invention. Such descriptions and representations are used by those skilled in the art to describe and convey the substance of their work to others skilled in the art. Various illustrative embodiments of the present invention will now be described in detail with reference to FIGS. 1-8. It is noted that, throughout this detailed description, certain elements in the figures are illustrated for simplicity and clarity and have not necessarily been drawn to scale. For example, the dimensions of some of the elements in the figures may be exaggerated relative to other elements to help improve the understanding of the embodiments of the present invention.

FIG. 1 illustrates a top view of a polishing pad 120 having a window aperture 122 formed therein. The polishing pad 120 may be formed from one or more foamed or porous materials that are flexible or semi-rigid, depending on the type and thickness of material used. Window aperture 122 may include a transparent or semi-opaque endpoint window that is formed from the same material as the remainder of the pad 120 or that is formed from a different material. However formed, the endpoint window allows a laser beam or other light source to access the surface of semiconductor wafer structure being polished. All polishing processes do not necessarily require the presence of a window aperture 122 in which case the aperture region would be comprised of the same material as the remainder of the pad.

Figure 2:
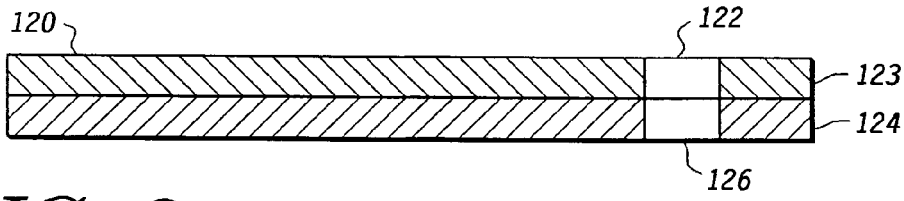
FIG. 2 illustrates a side view of a polishing pad of FIG. 1.

FIG. 2 illustrates a side view of a polishing pad 120 of FIG. 1. Pad 120 can include any suitable pad structure for a particular polishing operation. For example, in one embodiment, the polishing pad is a single pad layer, though one or more additional pad layers may also be included as depicted in FIG. 2, which shows a top layer 123 of polishing pad 120 that is affixed to a bottom layer 124 having an aperture 126 formed therein. An example of a CMP polishing pad that can be used is the IC1000 polish pad, though other pads may also be used. A pressure sensitive adhesive (not shown) may be used to affix the top layer 123 to the bottom layer 124. Where multiple pad layers are provided, each pad layer (e.g., 124) includes an aperture (e.g., 126) which is formed in alignment with the other pad window apertures (e.g., 122). In a selected embodiment, the aperture 126 may be formed by an opening or slit in the polishing pad layer 124.

Figure 3:
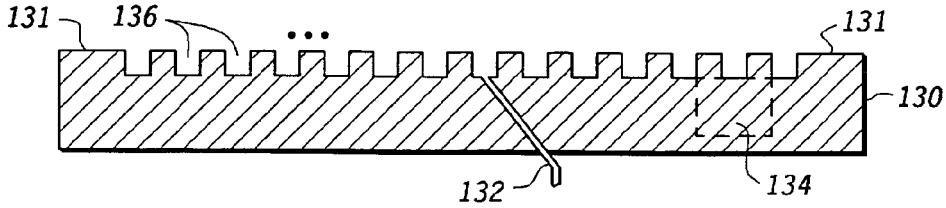
FIG. 3 illustrates a side view of a grooved platen in accordance with a first illustrative embodiment of the present invention.

FIG. 3 illustrates a side view of a grooved platen 130 in accordance with a first illustrative embodiment of the present invention which is configured to allow for the escape of any air trapped during assembly or operation of the polishing pad 120 and platen 130 through a first pathway 132. The pathway 132 provides a passage for trapped air (gas) to vent into an ambient environment separate from the polishing environment. In operation, a polishing pad (e.g., 120) is affixed to the platen 130 via a pressure sensitive adhesive layer (not shown). The platen is affixed to an underlying polishing equipment assembly (not shown), and the entire assembly rotates about a central axis. In addition, the platen 130 may include an endpoint detection window and/or sensor equipment (not shown) in a cavity or aperture 134 which is used to provide in-situ monitoring of CMP operations.

As illustrated, the platen 130 is formed with channels or grooves 136 on the interior of the upward face of the platen 130 that are sealed from the processing environment by an ungrooved portion 131 at the periphery of the platen 130. To form the grooves 136 in the platen 130, the platen may be cast, molded or machined by cutting grooves in the platen with a lathe, laser or other cutting machine. Because of the ungrooved portion 131, the grooves or channels 136 do not extend to the edge of the top surface of the platen 130, thereby preventing liquids, vapors or other undesirable contaminants from the CMP process from intruding into the area between the pad 120 and platen 130. However, a pathway 132 in the platen 130 is provided to release any air pockets trapped between the pad 120 and platen 130, and/or to discharge or relieve any increase in air pressure caused by the polishing operations. In the depicted embodiment, the pathway 132 is formed as an angled hole that is drilled through the platen 130 to an access hole (not shown) in the lower control area of the polishing equipment (not shown). The pathway 132 vents to an ambient or sub-ambient environment that is separate from the polishing environment.

By providing a pathway 132 to an ambient or sub-ambient environment, any trapped air pockets and/or increase air pressure between the pad 120 and platen 130 are readily removed or vented. However, the pathway 132 may be used to vent air pressure or pockets without requiring the use of vacuum equipment, thereby reducing the cost and complexity of the overall CMP assembly.

Figure 4:
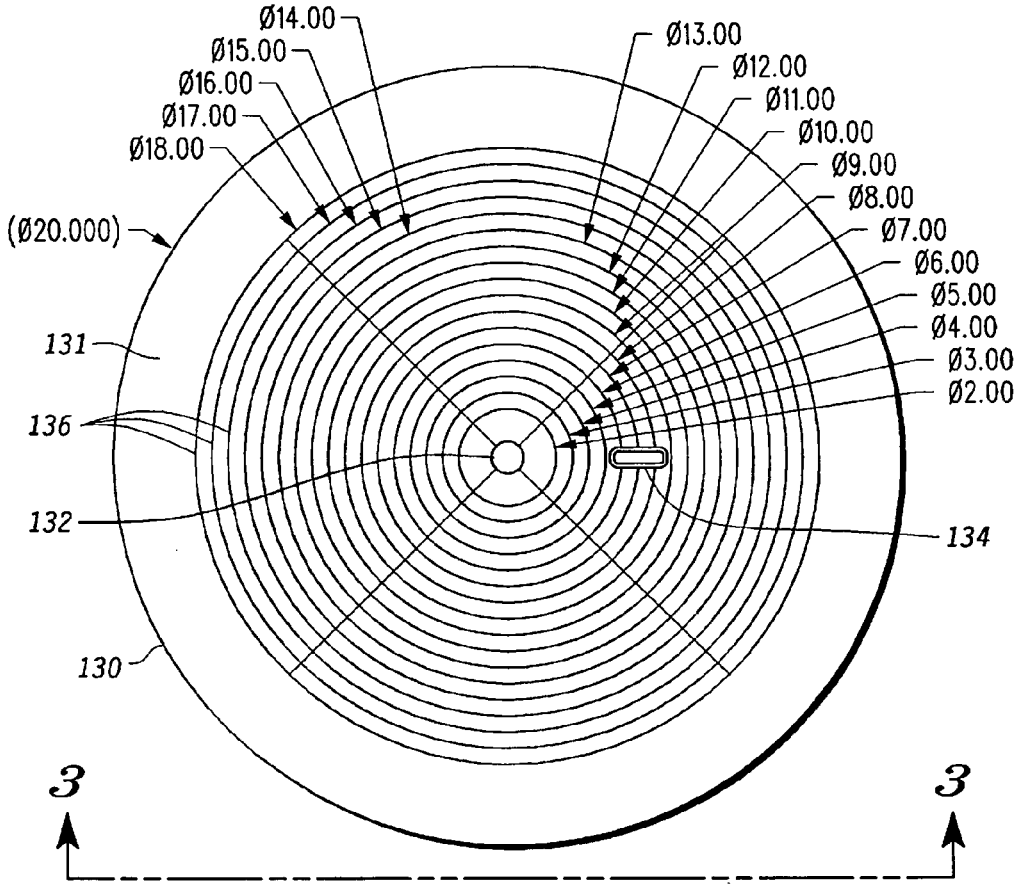
FIG. 4 illustrates a top view of the grooved platen of FIG. 3.

FIG. 4 illustrates a top view of the grooved platen 130 of FIG. 3 in which an illustrative groove pattern 136 is formed to intersect with an opening to the pathway 132. Depending on various design considerations (such as the diameter, thickness and/or flexibility of the polishing pad), the physical dimensions (e.g., size and spacing) of the pathway 132 and grooves 136 are configured to prevent or eliminate the formation of bubbles or trapped air pockets between the upper surface of the platen 130 and any applied polishing pad 120 or adhesive layer. In a first illustrative embodiment, an aluminum platen 130 is formed with grooves 136 that are spaced apart at half-inch intervals, that have a width of approximately 0.02 inches (e.g., 0.02±0.003 inches), that have a depth of approximately 0.02 inches (e.g., 0.02±0.003 inches) and that are sealed with a 1 inch ungrooved region 131 at the outer edge of the platen 130. In another illustrative embodiment, a ceramic platen 130 is formed with grooves 136 that are spaced apart at half-inch intervals, that have a width of approximately 0.03 to 0.04 inches, that have a depth of approximately 0.02 inches (e.g., 0.02±0.003 inches) and that are sealed with a 1 inch ungrooved region 131 at the outer edge of the platen 130.

In addition, the grooves 136 may be configured in any predetermined pattern (e.g., X-Y grid, radial pattern, starburst, concentric circles or any combination thereof) which is designed to cover or intersect with any minimum bubble spacing dimension. For example, to prevent the formation of half-inch (or larger) bubbles, a pattern of concentric grooves 136 are formed using half inch radial spacing from the center of the platen 130 and out to the ungrooved portion 131. By including an X-shaped groove in the pattern that is positioned to cross the radial grooves and to intersect with the first pathway 132, venting of the radial grooves 136 through the pathway 132 is provided.

Whatever pattern of grooves or channels 136 is used on the surface of the platen 130, the pattern should be positioned to overlay or intersect with one or more openings to the platen pathway(s) 132, thereby providing an air vent or path to ambient or sub-ambient environment that reduces or eliminates the formation of air pockets or bubbles. By removing or reducing air pockets between the pad and platen, localized pad wear and related pad deformations are minimized, non-uniform polishing characteristics are reduced, premature pad failure is prevented and manufacturing cycle time is reduced, thereby lowering costs and improving yield. In addition, by sealing the platen grooves 136 from the peripheral edges of the top surface of the platen 130, liquids, vapors or other undesirable contaminants from the CMP process are prevented from entering the grooved area between the pad 120 and platen 130.

Figure 5:
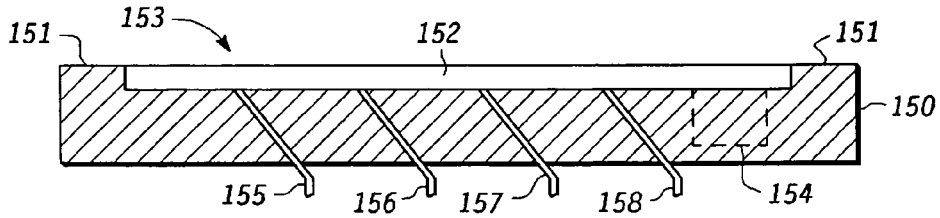
FIG. 5 illustrates a side view of a grooved platen in accordance with a first alternative illustrative embodiment of the present invention.

As will be appreciated, a variety of different grooved and vented platen configurations may be used to obtain various benefits of the present invention. For example, FIG. 5 illustrates a side view of a platen 150 in accordance with a first alternative illustrative embodiment of the present invention which is also configured to allow for the escape of any air trapped during assembly or operation of the polishing pad and platen 150 through one or more pathways 155-158. As illustrated, the platen 150 includes an endpoint detection window and/or sensor equipment (not shown) in an aperture 154 which is used to provide in-situ monitoring of CMP operations. In addition, the platen 150 is formed with a single channel or groove that creates a void, hollow or recess 153 in which is formed and/or affixed a rigid layer of porous air permeable material 152, though it will be appreciated that the porous material may also be formed within a plurality of grooves (such as shown in FIGS. 3-4). Examples of such porous materials include precision lapped porous ceramic. The porous layer 152 is positioned on the interior of the upward face of the platen 150 so that, as the polishing pad is affixed or adhered to the platen 150, any trapped air can pass through the porous layer 152 and into the pathway(s) 155-158. In addition, the porous layer 152 is sealed from the processing environment by an ungrooved portion 151 at the periphery of the platen 150 so that any liquids, vapors or other undesirable contaminants from the CMP process cannot reach the area between the pad and platen 150.

Figure 6:
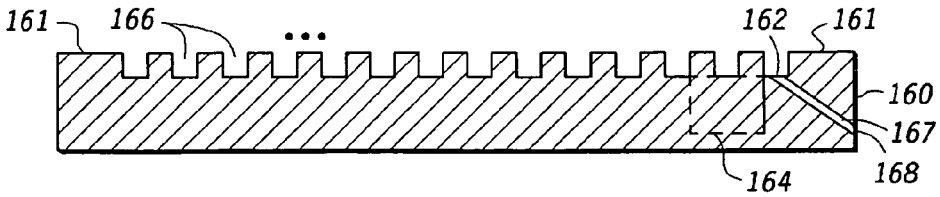
FIG. 6 illustrates a side view of a grooved platen in accordance with a second alternative illustrative embodiment of the present invention.

Yet another alternative illustrative embodiment of the present invention is depicted in FIG. 6, which illustrates a side view of a grooved platen 160 which includes one or more pathways 167 that connect the platen surface grooves or channels 162 to a peripheral side opening 168 in the platen 160 to release any air pockets trapped between the pad and platen 160, and/or to discharge or relieve any increase in air pressure caused by the polishing operations. As illustrated, the platen 160 includes an endpoint detection window and/or sensor equipment (not shown) in an aperture 164 which is used to provide in-situ monitoring of CMP operations. In addition, the platen 160 is formed with channels or grooves 166 on the interior of the upward face of the platen 160 that are sealed from fluid and/or humidity in the processing environment by an ungrooved portion 161 at the periphery of the platen 160. Any air pockets trapped between the pad and platen 160, as well as any increase in groove air pressure caused by the polishing operations, are released through one or more pathways 167 formed from an air permeable hydrophobic material that releases air without letting liquids, vapors or other undesirable contaminants from the CMP process to enter the area between the pad and platen 160. Such materials can be purchased, for example, from Porex Corporation. In addition or in the alternative, the pathways 167 may include a micro-check valve which is normally closed to prevent liquid vapor or other undesirable contaminants from the CMP processing environment from entering the grooved area 166, but is configured to open when internal pressure exceeds a predetermined pressure threshold, thereby venting air from the grooves 166.

Figure 7:
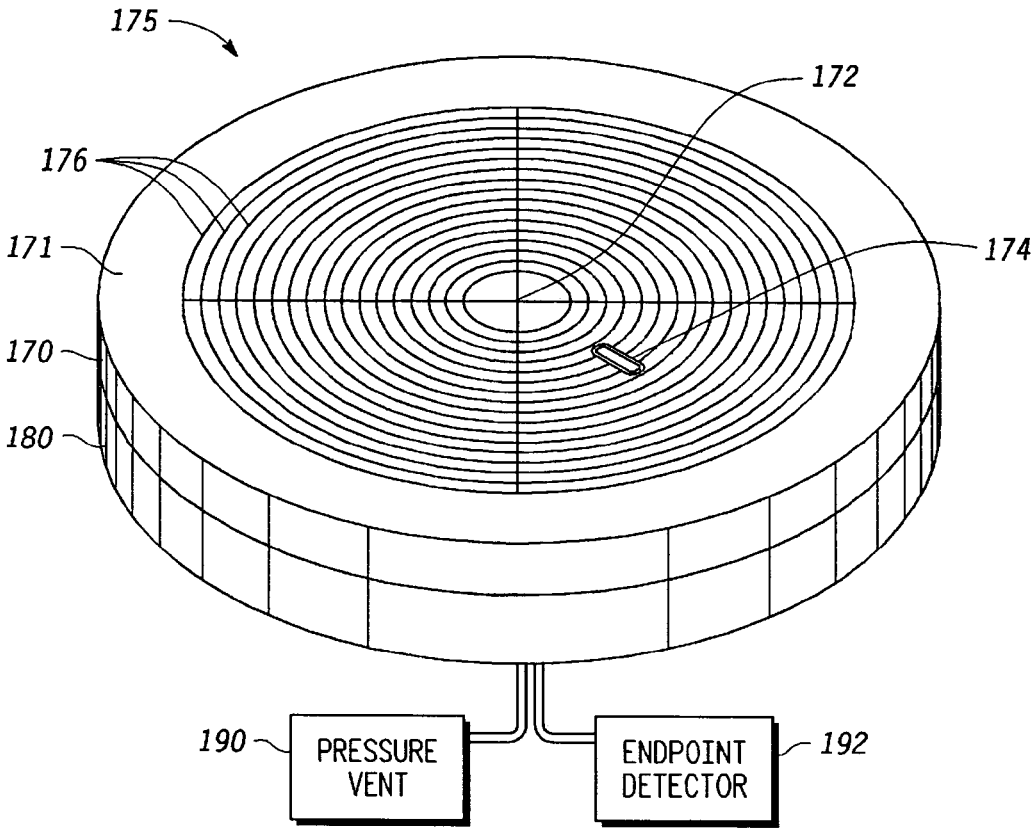
FIG. 7 illustrates an elevated view of a grooved platen assembly having pressure vent and endpoint detection systems.

Turning now to FIG. 7, an elevated view is illustrated of a grooved platen assembly 175 which includes a subplaten 180 that is part of the polisher equipment, and a platen 170 having a predetermined pattern of grooves or channels 176 contained within a sealing region 171. As described herein, the particular configuration and dimensions of the groove or channels 176 are chosen to provide adequate venting of any trapped air pockets or air pressure between the pad and platen 170.

The depicted grooved platen assembly 175 also includes a pressure vent system 190, and may optionally include an endpoint detection system 192. As will be appreciated, any of a variety of endpoint detection systems may be used in connection with various embodiments of the present invention. For example, an optical endpoint system may use a laser beam or other light source to access the surface of semiconductor wafer structure being polished through an aperture 174 in the platen. Alternatively, a friction endpoint system can be used to measure motor current on the platen/spindle to determine when the polishing transitions from one layer to another, or an eddy current endpoint system may be used to measure metal thickness in real time. In other embodiments, a white light detector endpoint detection system can use a sensor in the aperture 174 or at the edge of the platen, in which case the wafer is moved off of the pad for measurement. Yet another embodiment uses a sniffer endpoint detection system to detect the polishing status by placing a probe on the platen to detect the presence of a layer in the slurry during the polish process (e.g., detecting nitride during an STI polish). In yet other embodiments, a temperature-based endpoint detection system may be used to measure the temperature shift in the pad during film stack transitions. Alternatively, a Nova-type measurement system may be used to measure the wafer after polishing to predict how much polish is required for the next wafer and/or to determine if additional polishing is required for the current. In an illustrative embodiment shown in FIG. 7, the platen 170 includes an optical endpoint detection window and/or sensor equipment (not shown) which is designed to fit in the aperture 174 and to provide in-situ monitoring of CMP operations through an opening in the pad (not shown) that is affixed to the platen 170.

Figure 8:
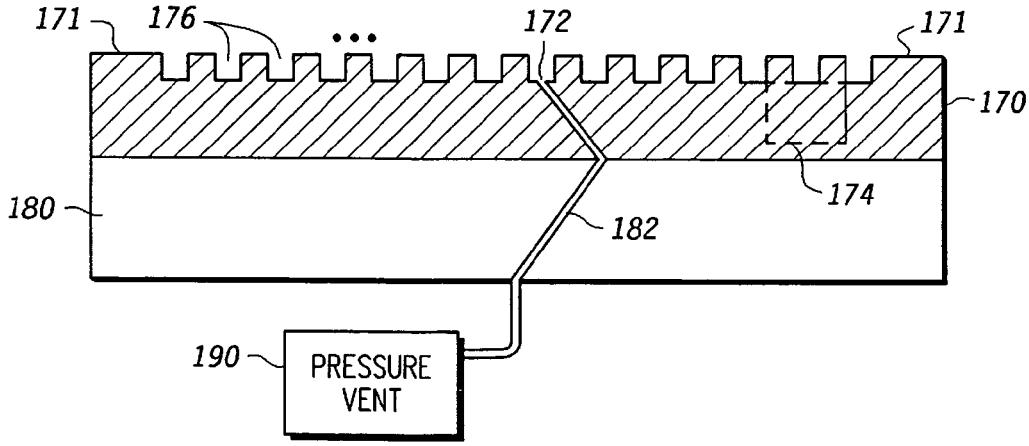
FIG. 8 illustrates a side view of the grooved platen assembly of FIG. 7.

The platen 170 also includes a vent pathway 172 for connecting the grooves 176 out to the ambient air or pressure vent system 170. An example of such a connection is depicted in FIG. 8, which illustrates a side view of the grooved platen assembly 175 of FIG. 7. As depicted, the vent pathway in the platen 170 is a first angled hole that connects the grooves 176 in the platen 170 to a second angled access hole in the subplaten 180, which in turn is connected to the ambient air or pressure vent system. As will be appreciated, additional vent pathways may be used, and may be formed at any desired angle and/or width, though the configuration of the vent pathway 172 should be chosen to intersect with a hole in the subplaten 180 that accesses ambient air or pressure vent system 190. For example, the vent pathway 172 may be formed as a hole with a diameter of approximately 0.12 inches and with its central axis tilted by approximately forty degrees from the top or bottom horizontal surface of the platen 170. Alternatively, the vent pathway 172 may be formed as a hole with a diameter of approximately 0.188 inches and with its central axis tilted by approximately 27 degrees from the top or bottom horizontal surface of the platen 170.

In operation, a polishing pad (not shown) is adhesively affixed to the platen 170 to form a polishing pad assembly which is rotated or spun about its central axis by a polisher (such as a 200 Mirra polisher). Because of the grooves 176 and platen passageway 172, air pockets between the pad and platen are vented so that no bubbles can form between the adhesive and the platen. A structure to be polished (e.g., a partially completed integrated circuit or wafer structure on which an interlayer dielectric or metal layer has been formed) is then placed in polishing contact with the spinning polishing pad assembly. For example, the structure is affixed to a polishing arm which spins and moves the structure back and forth while pressing the structure against the rotating polishing pad in the presence of a polishing slurry. This effectively achieves planarizing a deposited or upper layer on the structure being polished.

In one form, a rotatable platen apparatus is provided for use in performing chemical mechanical polishing. The platen may be disk shaped, and includes a peripheral side edge, a lower surface and an upper surface on which the polishing pad is adhesively affixed. In addition, the platen has a groove pattern formed on the upper surface, and also has one or more passageways formed in the platen. The groove pattern may be formed with any desired pattern, so long as the groove pattern intersects with the opening to the passageway. For example, the groove pattern may be an X-Y grid, a radial pattern, a starburst pattern, concentric circles or any combination thereof, with grooves having any desired dimension (e.g., a width or depth of at least approximately 0.02 inches). Alternatively, the groove pattern may be single sealed channel in which is formed a layer of porous material which allows air trapped during affixation of the polishing pad onto the platen to be vented through the passageway. In addition, the groove pattern is configured so that it does not extend to the peripheral edge of the platen, such as by including a perhipheral ungrooved portion in the upper surface which seals the grooved pattern from infiltration by polishing materials (such as abrasive materials, fluid and/or humidity) from the chemical mechanical processing environment when the polishing pad is affixed to the platen. The passageway(s) may be formed with any desired configuration (e.g., an angled hole between the lower surface and the upper surface with a diameter of at least approximately 0.12 inches), so long as it connects an opening in the upper surface groove pattern with a second opening in the platen. In selected embodiments, the passageway includes an air permeable hydrophobic material that releases air without letting liquid vapor or other undesirable contaminants from the chemical mechanical processing environment to infiltrate between the platen and the polishing pad. In these embodiments, the passageway may be formed in the platen to connect the upper surface groove pattern with an opening on a peripheral side edge of the platen. Through this passageway, air trapped between the platen and the polishing pad is able vent to an ambient environment without allowing fluids, vapors or contaminants from the polishing process to infiltrate between the platen and the polishing pad.

In another form, a method is described for performing chemical mechanical polishing. As a preliminary step, a platen is provided which has a groove pattern formed in the upper surface of the platen that does not extend to any peripheral edge of the platen. The groove pattern may be formed by molding, casting or machining grooves into the platen, and then optionally applying an air permeable porous material inside the groove pattern. In addition, the platen includes a passageway formed in the platen to connect the groove pattern with an external environment. Depending on the platen configuration, the passageway may be formed as an opening or hole in the platen, or may be formed with an air permeable hydrophobic material that releases air without letting contaminants from the chemical mechanical polishing enter in between the polishing pad and platen. A polishing pad assembly is then constructed by applying or adhesively affixing a polishing pad to the upper surface of a platen. While applying the polishing pad to the platen and during polishing operations, any air trapped between the platen and the pad is able to vent through the groove pattern and the passageway to the external environment. In addition, by sealing a peripheral edge of the polishing pad to the peripheral edge of the upper surface of the platen, contaminants from the chemical mechanical polishing are prevented from infiltrating between the platen and the polishing pad. Finally, the polishing pad assembly is used to perform chemical mechanical polishing of a wafer structure is performed by placing the polishing pad assembly in polishing contact with the wafer structure.

In yet another form, a method is described for assembling a polishing pad assembly which can be used in chemical mechanical polish processing. In the method, a platen is provided having one or more interconnected channels formed in an upper surface which are enclosed by a peripheral sealing region on the upper surface of the platen. The interconnected channels in the platen may be formed in any desired groove pattern, such as a pattern of concentric circles in combination with an X-shaped groove. The platen also includes a passageway that forms an air pathway between the interconnected channels and an external environment. A polishing pad is then adhesively affixed to the upper surface of the platen, which may require aligning the interconnected channels to intersect with the passageway while adhesively affixing the polishing pad to the platen. During affixation, air trapped between the platen and the polishing pad is vented through the channels and passageway without allowing contaminants from the chemical mechanical polish process to infiltrate between the platen and the polishing pad.

Although the described exemplary embodiments disclosed herein are directed to various examples of equipment used for performing chemical mechanical polishing, the present invention is not necessarily limited to the example embodiments. Thus, the particular embodiments disclosed above are illustrative only and should not be taken as limitations upon the present invention, as the invention may be modified and practiced in different but equivalent manners apparent to those skilled in the art having the benefit of the teachings herein. For example, alternative configurations and dimensions for the venting pathway and groove patterns may be used. Accordingly, the foregoing description is not intended to limit the invention to the particular form set forth, but on the contrary, is intended to cover such alternatives, modifications and equivalents as may be included within the spirit and scope of the invention as defined by the appended claims so that those skilled in the art should understand that they can make various changes, substitutions and alterations without departing from the spirit and scope of the invention in its broadest form.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A method for performing chemical mechanical polishing, comprising;

assembling a polishing pad assembly by applying a polishing pad to an upper surface of a platen having a groove pattern by applying an air permeable porous material inside the groove pattern, where the groove pattern does not extend to any peripheral edge of the upper surface of the platen and is vented to an external environment; and performing chemical mechanical polishing of a wafer structure by placing the polishing pad assembly in polishing contact with the wafer structure.

2. The method of claim 1, where assembling a polishing pad assembly comprises sealing a peripheral edge of the polishing pad to the peripheral edge of the upper surface of the platen to prevent contaminants from the chemical mechanical polishing from infiltrating between the platen and the polishing pad.

3. The method of claim 1, further comprising forming at least one passageway in the platen to connect the groove pattern with the external environment, such that air trapped between the platen and the polishing pad is able to vent through the passageway without allowing contaminants from the chemical mechanical polishing to infiltrate between the platen and the polishing pad.

4. The method of claim 3, where the passageway is formed with an air permeable hydrophobic material that releases air without letting contaminants from the chemical mechanical polishing to enter in between the polishing pad and platen.

5. The method of claim 1, further comprising forming the groove pattern in the platen by machining grooves into the platen.

6. The method of claim 1, further comprising forming the groove pattern in the platen by molding, casting or machining the platen.

7. The method of claim 1, where assembling a polishing pad assembly comprises:

adhesively affixing the polishing pad to the upper surface of the platen; and venting any air trapped between the platen and the polishing pad through the groove pattern and a passageway formed in the platen without allowing contaminants from the chemical mechanical polishing to infiltrate between the platen and the polishing pad.

8. A method for performing chemical mechanical polishing, comprising;

assembling a polishing pad assembly by applying a polishing pad to an upper surface of a platen having a groove pattern which does not extend to any peripheral edge of the upper surface of the platen and which is vented to an external environment;

forming at least one passageway in the platen with an air permeable hydrophobic material to connect the groove pattern with the external environment, such that air trapped between the platen and the polishing pad is able to vent through the air permeable hydrophobic material in the passageway without allowing contaminants from the chemical mechanical polishing to infiltrate between the platen and the polishing pad; and performing chemical mechanical polishing of a wafer structure by placing the polishing pad assembly in polishing contact with the wafer structure.

9. The method of claim 8, where assembling a polishing pad assembly comprises sealing a peripheral edge of the polishing pad to the peripheral edge of the upper surface of the platen to prevent contaminants from the chemical mechanical polishing from infiltrating between the platen and the polishing pad.

10. The method of claim 8, further comprising forming the groove pattern in the platen by machining grooves into the platen.

11. The method of claim 8, further comprising forming the groove pattern in the platen by molding, casting or machining the platen.

12. The method of claim 8, where assembling a polishing pad assembly comprises:

adhesively affixing the polishing pad to the upper surface of the platen; and venting any air trapped between the platen and the polishing pad through the groove pattern and a passageway formed in the platen without allowing contaminants from the chemical mechanical polishing to infiltrate between the platen and the polishing pad.

13. The method of claim 8, further comprising applying an air permeable porous material inside the groove pattern.

* * * * *